US006431089B1

(12) United States Patent
O'Brien

(10) Patent No.: US 6,431,089 B1
(45) Date of Patent: Aug. 13, 2002

(54) TABLE COVERS

(76) Inventor: Eileen O'Brien, 143 Passaic Ave., Summit, NY (US) 07901

( * ) Notice: Subject to any disclaimer, the term of this patent is extended or adjusted under 35 U.S.C. 154(b) by 0 days.

(21) Appl. No.: 09/564,560

(22) Filed: May 4, 2000

(51) Int. Cl.[7] ..... A47G 9/00
(52) U.S. Cl. ..... 108/90
(58) Field of Search ..... 100/90; 150/158

(56) References Cited

U.S. PATENT DOCUMENTS 54,390 A * 5/1866 Munson ..... 108/90
3,939,976 A * 2/1976 Vaniseghem, Jr. ..... 108/90 X
3,960,193 A * 6/1976 Davis ..... 150/158 X
3,998,221 A * 12/1976 Collins ..... 108/90 X
4,777,992 A * 10/1988 Olger ..... 108/90
4,991,242 A * 2/1991 Brown ..... 108/90 X
5,284,099 A * 2/1994 Cohen ..... 108/90
5,449,539 A * 9/1995 Stepanek ..... 108/90 X
5,506,019 A * 4/1996 Abeyta et al. ..... 108/90 X
6,116,167 A * 9/2000 Rabe ..... 108/90

FOREIGN PATENT DOCUMENTS

GB 25616 * 12/1904 ..... 108/90

* cited by examiner

*Primary Examiner*—Jose V. Chen
(74) *Attorney, Agent, or Firm*—Leo Stanger

(57) ABSTRACT

A table cover made of a fabric extension runner the width of a placemat and long enough to run the length (or width) of a table top.

7 Claims, 3 Drawing Sheets

TABLE COVERS

BACKGROUND

My invention is a kind of table covers—decorative and protective extension runners.

The invention of this application is described in the inventor's Disclosure Document Ser. No. 472,472, filed Apr. 2, 2000, the contents of which are incorporated by reference into this patent application.

The prior art teaches a variety of table coverings. These include flat sheet coverings, scored and folded coverings, and covers actively secured (tied or clipped) to the table.

Flat Sheet Covering

The simplest prior art table coverings include table cloths, a single sheet of flat material covering substantially all of the table surface, and place mats, placed under plates and occasionally also in the middle of the table, under center-pieces and the like. Such flat-piece constructs are easy and inexpensive to make, yet may not cover the entire surface to be protected, or may not "fit" the surface well.

Thus, the more complex prior art involves taking a flat sheet and modifying it to make it fit the table surface better. Such fitting has been accomplished in two general approaches: first, by passively fitting the cover to the table by scoring and folding or tearing the cover; and second, by actively holding the cover to the table by adding tie flaps, clips or other restraints to actively hold the cover to the table surface.

Scored and Folded Articles

Glover, U.S. Pat. No. 3,825,050, discloses a table cover consisting of a sheet of non-absorbent material adapted to overlie a table and depend at its edges about the table. The invention is a single sheet, formed with a plurality of separate flaps extending peripherally about a central portion of the sheet. The flaps are adapted to overlie the edge portions of the table.

Vanlseghem, U.S. Pat. No. 3,939,976, discloses a roll of flexible material divided into multiple individual table place setting sections. The sections are separated from each other by perforations for removal of one or more as desired.

Cohen, U.S. Pat. No. 5,284,099, discloses a table mat of rectangular construction of disposable, "relatively heavy paper" covering the entire table top. Because relatively heavy paper bends somewhat clumsily, Cohen requires at least one pair of parallel lines of perforations, scores or creases. These scores in the heavy paper permit end areas of the mat to be folded down to drape over the sides of a table.

Tied or Clipped Covers

Fink, U.S. Pat. No. 4,393,104, discloses a table place mat having a cover removably attached to a rigid support member. The support member is preferably made of a wood material, and the cover is formed of a flexible material and provided with elastic material along its perimeter to maintain the cover in position around the rigid support.

Jones, U.S. Pat. No. 4,627,363, discloses a table covering apparatus for securing a table covering to a table, utilizing a series of opposed pairs of strips releasably attached to a location underneath one edge of the table.

Hairston et al., U.S. Pat. No. 5,778,802, discloses a table cover system that includes a top and a side when the table cover is spread upon a table. An elongated panel includes a plurality of "elongated, slender cloth segments" or hanging loops there-along, and is configured to fasten to the side of the table cover.

Abeyta et al., U.S. Pat. No. 5,506019, discloses a table cover for covering a top surface and open side areas of a table. The inventive device includes a top cover web having opposed top cover longitudinal edges thereof place able over the top surface of an associated table structure. A first side web drape is coupled to a first edge of the top cover so as to hang downwardly there from to cover a first open side area of the table.

Forman et al., U.S. Pat. No. 5,712,012, discloses an adaptable, disposable place mat which includes a sheet of cellulose material and adhesive on their bottom surfaces for affixing them to a dining surface.

Figueroa, U.S. Pat. No. 4,708,183, teaches a combination table cover and skirt retainer, connectable to the edges of a table, comprising a top cover, a skirt, and retainer members connectable to the top cover and the skirt.

Summary of the Prior Art

The prior art discloses examples of table coverings which passively fit the cover to the table by scoring and folding or tearing, or which actively hold the cover by tie strips, clips or the like. What is needed, however, is a table cover which is both: (1) as simple and inexpensive to manufacture and to use as a single-piece flat table cover, and (2) which has the ability to fit any size table well, like the covers which are scored, folded, tied, and/or clipped or the like. Similarly, the prior art table covers cover the entire table surface. While this may be desirable for unattractive tables, many people invest in beautiful dining tables, so there is a need for a protective cover which both selectively protects the parts of the table needing protection (e.g., near plates), yet also reveals the attractive table surface in other areas.

I have found a way.

SUMMARY

My invention is at once simple and, because it is so elegant, really effective. My invention comprises using one or more "extension runners." The term "extension runner" is a phrase I coined (as there is no pre-existing phrase to denote my invention) to denote a placemat-type article of reusable textile or fabric which is about the width of a placemat (roughly eighteen to twenty two inches wide) but, unlike a placemat, is extremely elongated—so long as to be able to run the entire length (or width) of a table, and, if desired, to drape over the table edges a bit.

DRAWINGS

DETAILED DESCRIPTION

My invention comprises extension runners, and using one or more extension runners to drape over a table, to provide a protective and decorative table covering. (I use the term "table" herein to denote conventional tables, and also to include other furniture which may want covering (e.g., credenzas, end-tables, secretaries, side-boards, breakers, etc . . . )).

Extension runners provide a protective table covering as do place mats, but also are easier to use (you need fewer of them) and provide a unique attractive appearance. Using a plurality of extension runners is better in some ways than the prior art solutions, which entail struggling to fit one large piece of material onto a table. With my approach, fitting is accomplished without scoring and folding, but by simply combining extension runners of the correct length to cross the table surface only at the desired laces needing the most protection or covering.

As I mentioned, the width of an extension runner is about the width of a place mat—much less than the width of the standard table surface. By having a width narrower than the width of the table top, the "fitting" problem inherent in the prior art one-piece table covers is avoided. Thus, this eliminates the manufacturing expense and use inconvenience inherent in covers that one needs to score, fold, clip or otherwise fit the cover to the table top.

While it is possible to use any material to make extension runners, I prefer to use textiles. Such materials are re-useable, drape easily and attractively, are pliable, and may be made reversible.

Figure 1:
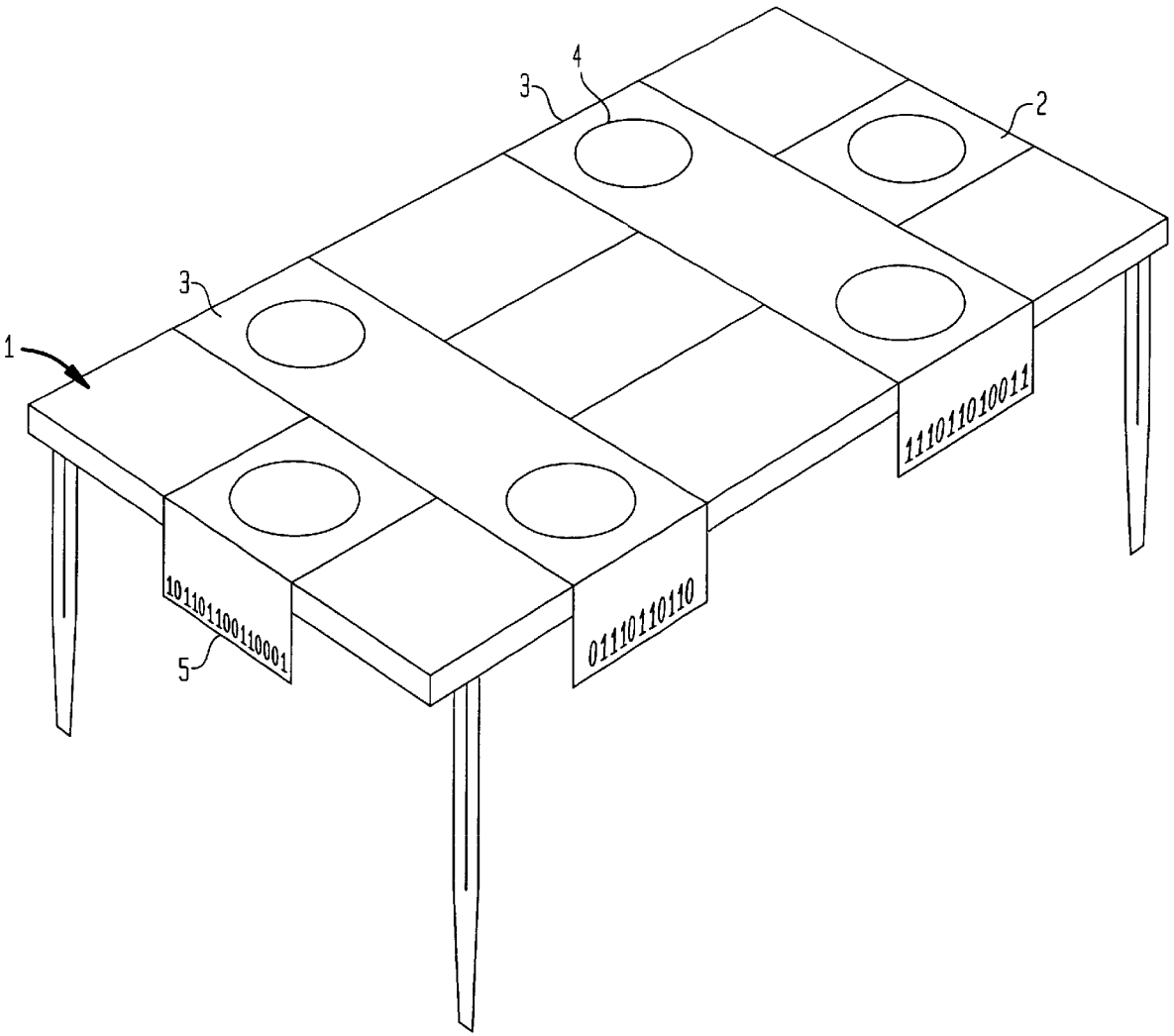
FIG. 1 shows a view of a table bearing a plurality of extension runners according to the invention.
Figure 2:
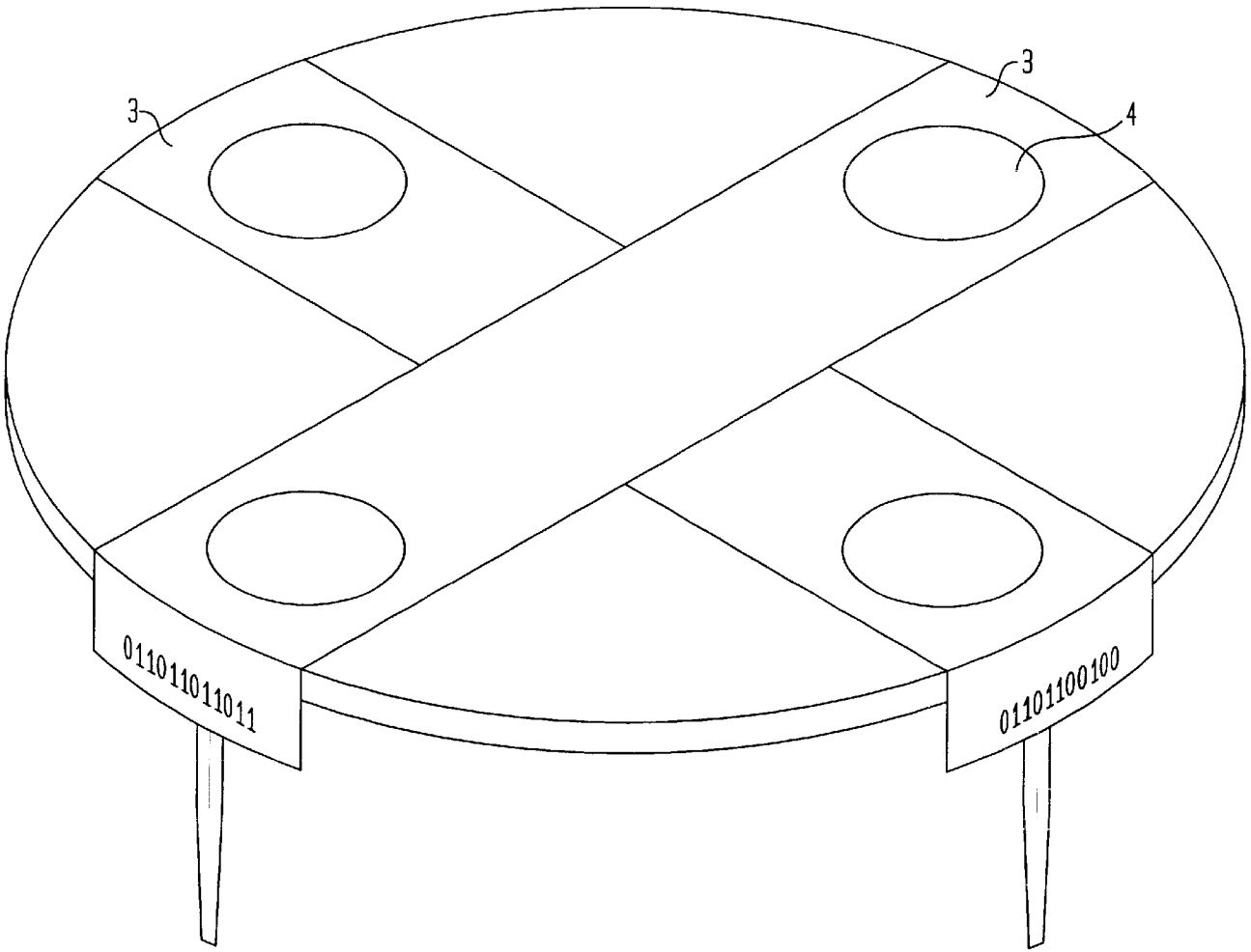
FIG. 2 shows a view of a table bearing a plurality of runners according to the invention.
Figure 3:
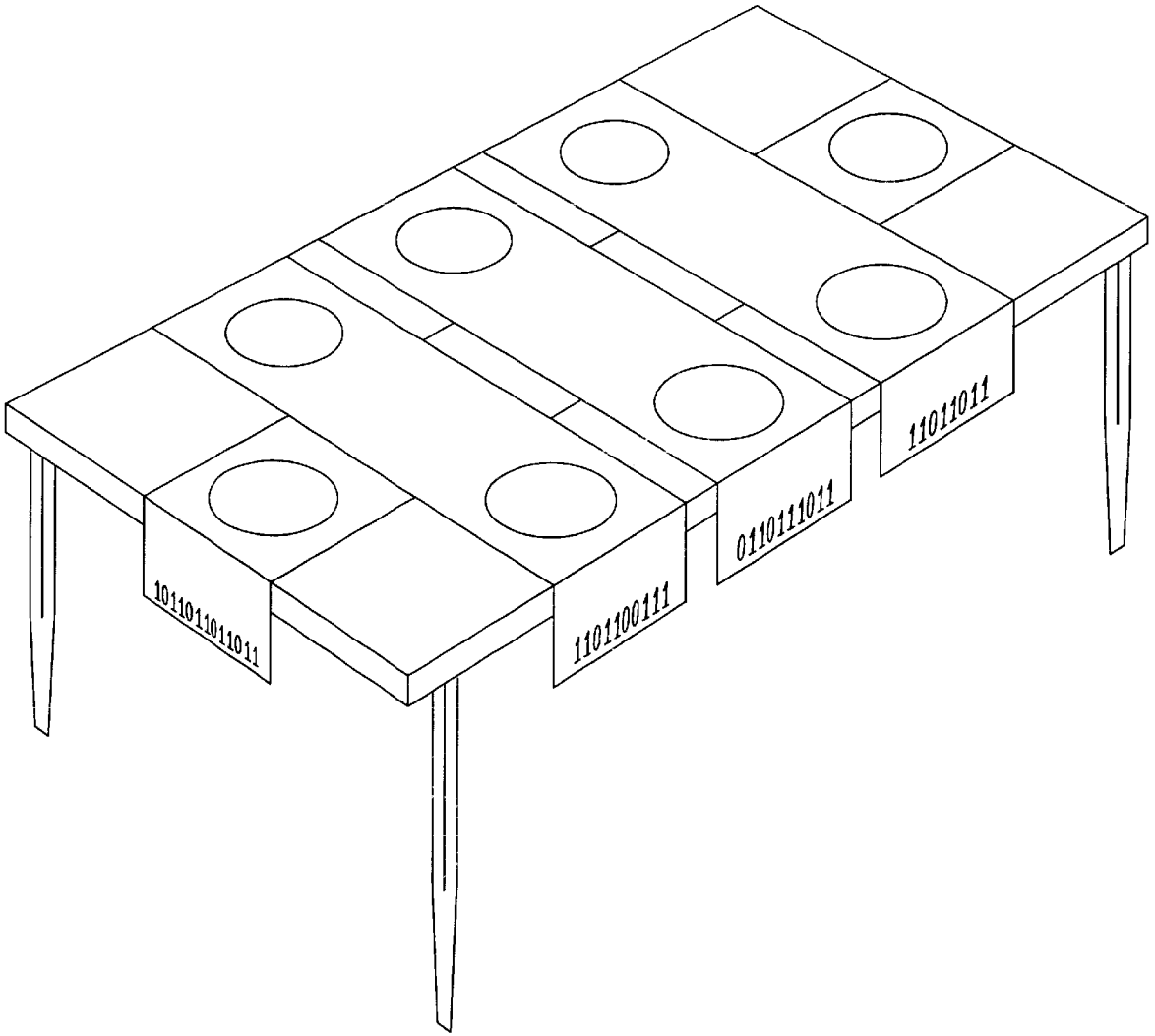
FIG. 3 shows a view of a table bearing a plurality of extension runners according to the invention.

My invention works for various numbers of meal place settings. See FIG. 1. For example, you can cover a rectangular table [1] and set it up for service for six, by laying one longer runner [2] down the length of the table, and two shorter runners [3] across the table, parallel to each other and perpendicular to the longer runner. With this version, you can put a place setting at each of the two ends of the table, and another two place settings along each of the two sides of the table. If the table is expanded (as by adding a table leaf), you can add a third shorter runner between the two shorter parallel runners, enabling you to put a third place setting on each table side, for service for eight.

A version of my invention particularly convenient to use, is to provide sets of several extension runners, pre-sized to fit standard table sizes, and allow for a few inches of "drape" of each extension runner end over the table edge. For example, an extension runner set can be made with a pair of 52 inch long runners, to fit a standard square table. Another extension runner set, including a 70 inch and one or two 52 inch extension runners, will fit a standard rectangular table. Runner sets of several 60 inch extension runners (to go across the table top), and one extension runner of 84, 90 or 120 inches (to go the length of the table) will fit other standard table sizes.

You can make my invention by using such pre-cut extension runners, but it is not necessary to use pre-cut runners. Rather, it may prove convenient to provide extension runners as a bolt (a long roll) of uncut extension runner stock, which uncut extension runner stock can then be cut to appropriate length dimensions as desired. By providing such a bolt of extension runner stock, you can cut extension runners as needed to fit tables of irregular or non-standard sizes, or new (perhaps larger) table sizes.

My invention works with round tables also. For example, with a circular or oval table, you can lay a simple cross of same-length runners [4] to allow service for four, or add additional runners as needed for service for additional diners.

My invention can be made of any desired textile. The fabric can be plain, or adorned with design elements or decoration, including holiday theme decoration or the like. Further, because my invention will be used in a place where the users inevitably look at it for extended periods of time (e.g., the duration of a meal), it provides an ideal medium for displaying messages, such as inspirational messages [5], product specific advertising, brand names, and corporate image advertising or communications (I refer to this kind of material as "commercial communications").

An important function of my invention is that it protects the table surface. This protective function is achieved in part by the textile of the runners themselves, which protect the table from excessive heat. If desired, protection against moisture can be obtained also, by putting plastic, oil cloth or another vapor barrier between the runner and the table surface.

Another important function of my invention is to provide a decorative function. Because it leaves part of the table surface exposed, I prefer that my invention also provide this decorative function. Thus, I prefer that to practice my invention, one use some type of fabric extension runners, rather than paper extension runners, as paper extension runners of like dimension and arrangement might create a cheap or shoddy appearance and fail to provide the nice decorative effect of fabric, nor be re-useable, permanent, washable (or dry cleanable), as fabric is.

My invention also provides design capabilities significantly different from, and more sophisticated than, that available with the single-piece table covers of the prior art. Because my approach uses several different runners, you can use my invention to make "meta-designs," choosing an aesthetic for the runner textile itself (e.g., putting a design in the woven structure itself, or printing a design on greige goods, and choosing an aesthetic for the arrangement of that fabric on the table. The prior art allows the former type of design choice, but, because the prior art uses one-piece constructs, it does not enable one to do the latter.

SUMMARY

While I discuss various versions of my invention, I give these as examples only, not to limit the coverage of my patent to these specific examples. Thus, I want my patent to be given the full coverage afforded under the appended Claims and equivalents of them. Similarly, I use the term "a" to include both one and more than one.

I claim:

1. An assembly for covering a part of a top surface of a table, comprising a lengthwise extension runner having a length dimension adapted to extend approximately equal to a length dimension of the top surface of the table, and a plurality of widthwise extension runners each having a length dimension adapted to extend approximately equal to a width dimension of the top surface of the table, said lengthwise extension runner and said widthwise extension runners adapted to have width dimensions sufficiently narrow to expose a portion of the top surface of the table at sides of said lengthwise and widthwise extension runners and between said widthwise extension runners.

2. An assembly according to claim 1, wherein, said plurality of extension runners are packaged together as one set.

3. An assembly according to claim 2, wherein said lengthwise extension runner has a length of about 52 inches or greater and each of said widthwise extension runners has a length of about 52 inches or greater.

4. The multi-part table cover of claim 1, wherein at least one of said runners further includes commercial communication viewable by a user of said table cover.

5. The extension runner of claim 1, available as a bolt of uncut extension runner stock which can be cut to appropriate length dimensions to fit various table dimensions.

6. An assembly as in claim 1, wherein said lengthwise extension runner has a length dimension adapted to extend at least as long as the length dimension of the top surface of the table, said widthwise extension runner has a length dimension adapted to extend at least as long as the width dimension of the top surface of the table.

7. An assembly as in claim 1, wherein said lengthwise extension runner has a length dimension adapted to extend longer than the length dimension of the top surface of the table, said widthwise extension runner has a length dimension adapted to extend longer than the width dimension of the top surface of the table.

* * * * *

UNITED STATES PATENT AND TRADEMARK OFFICE

CERTIFICATE OF CORRECTION

PATENT NO. : 6,431,089 B1
DATED : August 13, 2002
INVENTOR(S) : Eileen O'Brien

It is certified that error appears in the above-identified patent and that said Letters Patent is hereby corrected as shown below:

Title page,
Item [76], Inventor, should read
-- Eileen O'Brien
143 Passaic Ave
Summit NJ (US) 07901 --

Signed and Sealed this

Third Day of June, 2003

JAMES E. ROGAN
*Director of the United States Patent and Trademark Office*